US005491905A

United States Patent [19]

Jablonski et al.

[11] Patent Number: 5,491,905

[45] Date of Patent: Feb. 20, 1996

[54] APPARATUS FOR ACCURATELY SPACING RAILING SPINDLES

[76] Inventors: Jeffrey C. Jablonski, 27868 Greens Point Rd., Red Wing, Minn. 55066; Roger A. Dosdall, N2961 - 945th St., Hager City, Wis. 54014; Mitchell R. Boldt, 1526 South Park, Red Wing, Minn. 55066

[21] Appl. No.: 233,885

[22] Filed: Apr. 26, 1994

[51] Int. Cl.[6] ..... G01B 5/14

[52] U.S. Cl. ..... 33/613; 33/481

[58] Field of Search ..... 33/613, 562, 520, 33/481, 194; 269/36, 43, 904, 910

[56] References Cited

U.S. PATENT DOCUMENTS

| | | | |
|---|---|---|---|
| 45,098 | 11/1864 | Wallmer . | |
| 90,138 | 5/1869 | Van Syckel . | |
| 880,252 | 2/1908 | Tennent | 33/194 |
| 1,549,671 | 6/1923 | Kridler et al. . | |
| 1,834,026 | 12/1931 | Hall . | |
| 2,567,586 | 9/1951 | Werder . | |
| 2,791,841 | 5/1957 | Roenfeld | 33/613 |
| 2,969,819 | 1/1961 | Bravo | 269/904 X |
| 3,168,305 | 2/1965 | Lee | 33/194 |
| 3,888,477 | 6/1975 | Tate | 269/82 |
| 4,237,614 | 12/1980 | Williams . | |
| 4,350,279 | 9/1982 | Haley . | |
| 4,843,726 | 7/1989 | Ward | 33/613 |
| 4,958,814 | 9/1990 | Johnson | 269/43 |
| 5,190,266 | 3/1993 | Barrera | 254/17 |
| 5,364,084 | 11/1994 | Karash | 269/904 X |

*Primary Examiner*—Alvin Wirthlin
*Attorney, Agent, or Firm*—Kinney & Lange

[57] ABSTRACT

A jig for installing spindles has a base member, a jig alignment guide attached to the base member, and a spindle alignment guide secured to the base member. The spindle alignment guide is shaped to align an unsecured spindle in parallel relation to an adjacent spindle at a predetermined distance from the adjacent spindle while simultaneously positioning the unsecured spindle at a desired height in relation to a reference surface.

18 Claims, 9 Drawing Sheets

APPARATUS FOR ACCURATELY SPACING RAILING SPINDLES

BACKGROUND OF THE INVENTION

The present invention relates to jig-type tools, adaptable broadly for use in spacing objects of various kinds. More specifically the present invention relates to tools for uniform and parallel spacing of individual railing spindles in railing systems.

Spindle railing systems are ubiquitous fixtures found most commonly at the edges of decks, balconies, staircases, and the like. Spindle railing systems typically comprise a plurality of railing spindles extending from a floor, rim joist, skirt board or bottom railing cord to a top railing cord. The spindles are generally spaced apart by a predetermined distance and positioned parallel to each other. Similar structures may also be found in a variety of fences which use spaced boards or spindles to create a barrier, such as a picket fence. The spaced boards or spindles may be positioned vertically, horizontally, or at any angle therebetween.

When constructing a spindle railing on the edge of a deck, for example, workmen are required to make several individual hand measurements with a rule, including frequent re, checking of placement of the spindles' lateral spacing and height. The variable nature of the procedure often results in uneven and non-uniform lateral spacing of the spindles, non-parallel alignment of the spindles and uneven height of the spindles. In addition, a large amount of time is required for measuring and placing each individual spindle.

Occasionally, a spacer or jig for aiding in the spacing of the spindles is constructed, often of scrap materials from the construction site. These make-shift jigs are typically crude blocks of wood used simply to space the spindles the appropriate distance apart. Such spacers or jigs are useful only for a single spindle alignment, and new spacers or jigs must be constructed each time a new spindle alignment is desired. Also, the make-shift jigs or spacers do not typically aid in accurately locating the spindle height, and they do not typically aid in maintaining the spindles in a parallel or "plumb" relationship with one another.

One reason for the use of the make-shift jigs or spacers, despite the above-noted shortcomings, is that local building codes often specify a specific distance to be maintained between railing spindles and specific railing heights. The local codes vary from city to city and from state to state, so a single fixed jig or spacer cannot accommodate all of the different requirements. Therefore, a jig or spacer is typically constructed at each building site to conform with the local building code. The repeated construction of jigs or spacers at each construction site is time consuming, and the resulting jigs or spacers, as noted above, typically do not satisfy all of the builder's needs. Accordingly, there is a need for an improved jig for use in positioning and aligning railing spindles and the like.

SUMMARY OF THE INVENTION

The present invention provides an easily adjustable jig which allows spindles or boards to be accurately spaced apart by a predetermined distance and aligned parallel to one another. The present invention also allows accurate location of the height of the spindles as they are attached to the railing system. Further, the present invention allows placement of railing spindles in an offset relationship with respect to the edge of a board or other surface.

The present invention includes an elongated base member with a jig alignment guide secured to an end of the base member. The jig alignment guide aligns the base member with an initial starting point and from each subsequently installed railing spindle. The jig alignment guide also denotes a starting point from which index markings extend to progressively gauge a predetermined spacing of the spindles. A spindle alignment guide is releasably secured to the base member and spaced from the jig alignment guide. The spindle alignment guide and the jig alignment guide are positioned relative to each other and shaped to cause sequentially installed spindles to be in parallel relation with each other. The distance between the spindle alignment guide and the jig alignment guide can be determined by the index markings on the base member, with the distance between the spindle alignment guide and the jig alignment guide defining the distance between adjacent spindles. A jig offset guide releasably attached to the support base allows spindles to be mounted in an offset position relative to the edge of a board or other surface.

While the above-identified drawing features set forth preferred embodiments, this disclosure presents illustrative embodiments of the present invention by way of representation and not limitation. It should be understood that numerous other modifications and embodiments, which fall within the scope and spirit of the principles of the invention, can be devised by those skilled in the art.

DETAILED DESCRIPTION OF THE PREFERRED EMBODIMENTS

The present invention is a device for use in uniformly installing spindles. The description herein is directed to the installation of spindles in railing systems. However, it is contemplated that the inventive apparatus is useful in the efficient and effective installation of other systems which utilize evenly and uniformly spaced longitudinal elements.

Figure 1:
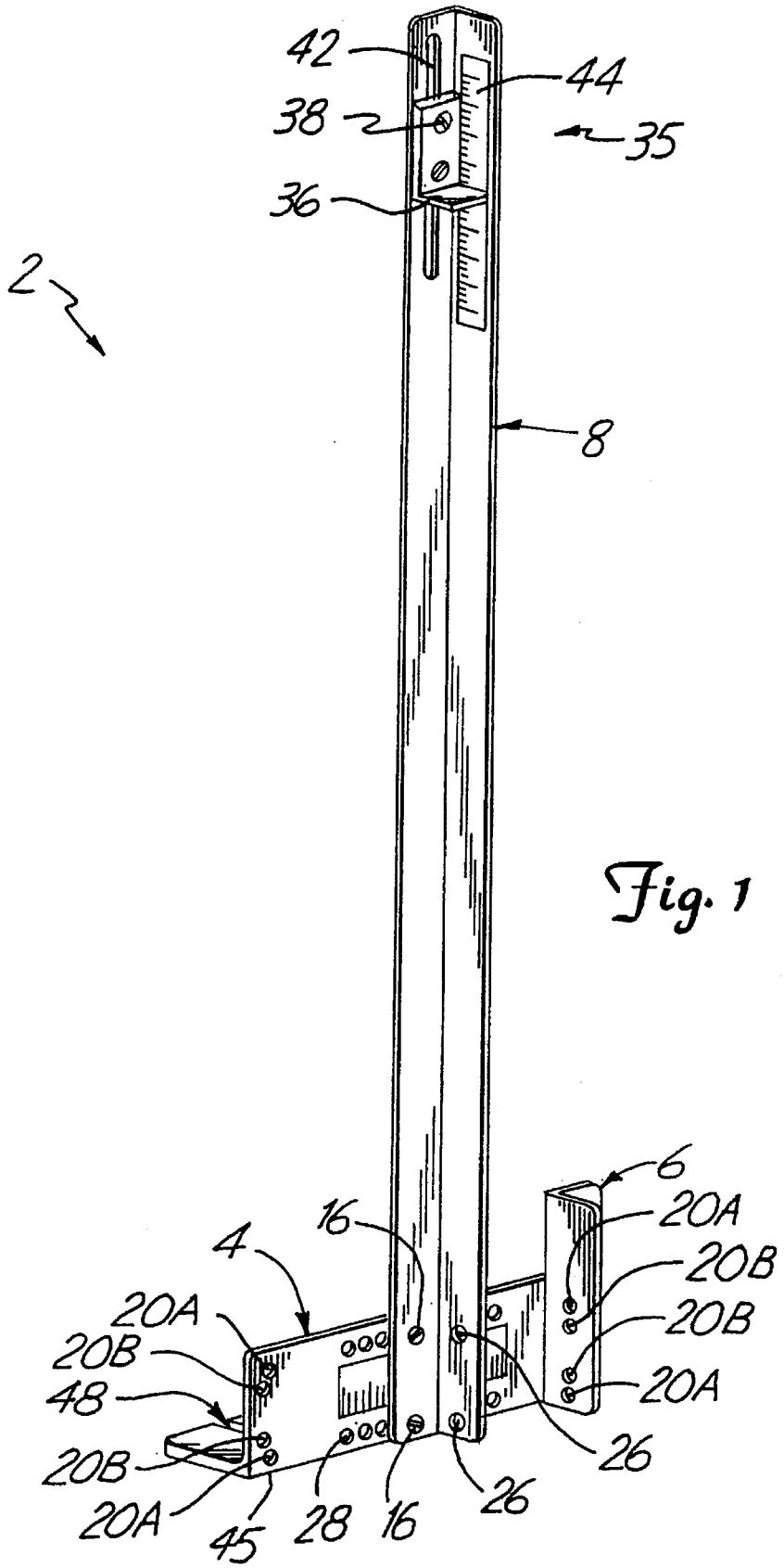
FIG. 1 is a perspective view of the present invention.
Figure 2:
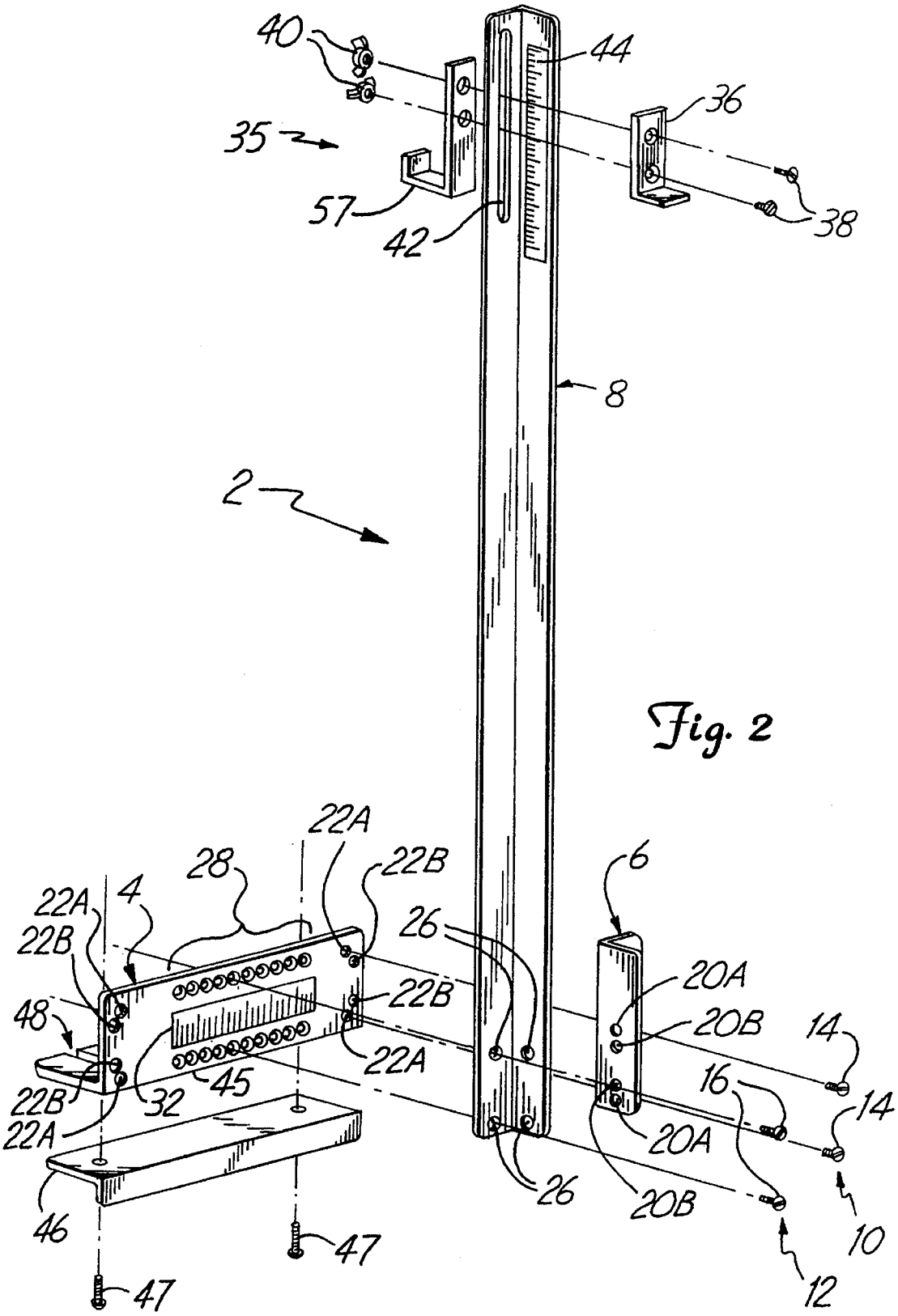
FIG. 2 is an exploded perspective view of the present invention.
Figure 3:
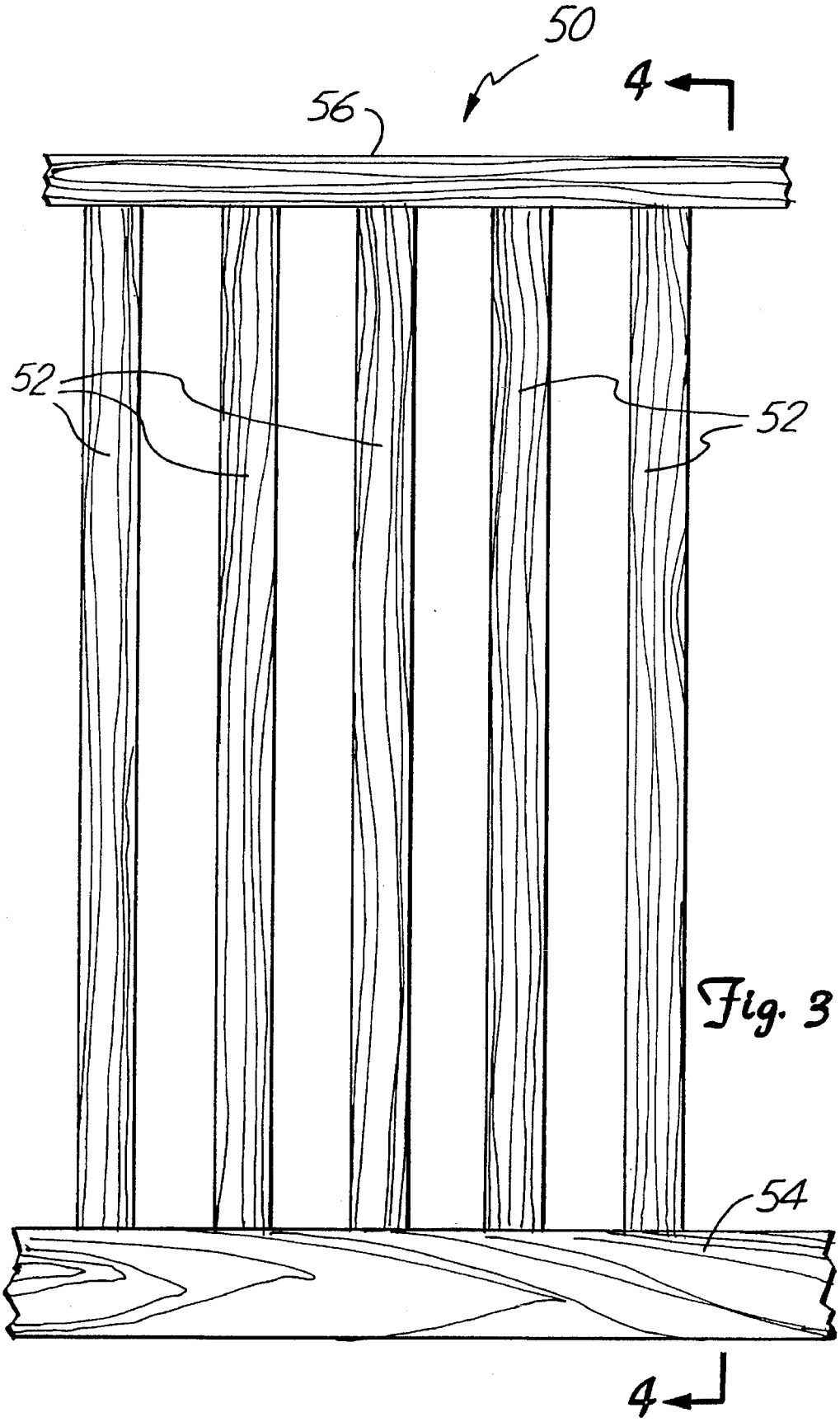
FIG. 3 is an elevational view of a spindle railing system.

As seen in FIGS. 1 and 2, the jig 2 of the present invention includes an elongated base 4, a jig alignment guide 6, and a spindle alignment guide 8. While the jig alignment guide 6 and the spindle alignment guide 8 are depicted in the FIGURES as L-shaped channels, the jig alignment guide 6 and the spindle alignment guide 8 may be of any suitable size and shape to align an unsecured spindle in parallel relationship to an adjacent spindle. For example, the jig alignment guide 6 and the spindle guide 8 may be in the forms of pins extending from the base 4. The jig alignment guide 6 and the spindle guide 8 are releasably secured to the base 4 by fastening means 10 and 12, respectively. Fastening means 10 and 12 are depicted in FIGS. 1 and 2 as screws 14 and 16, respectively, which are threadably secured to the base 4. The fastening means 10 and 12 may alternatively be a nut and bolt combination, or any other suitable fastening means known in the art.

As best seen in FIG. 2, the jig alignment guide 6 is releasably secured to the base 4 by the screws 14 which pass through either positioning holes 20A or positioning holes 20B in the jig alignment guide 6 and then through corresponding positioning holes 22A or positioning holes 22B in the support base 4. The positioning holes 20A align with the positioning holes 22A, while the positioning holes 20B align with the positioning holes 22B. Thus, the jig alignment guide 6 may be positioned such that either the holes 20A and 22A align with each other, or such that the holes 20B and 22B align with each other. This allows the jig alignment guide 6 to be selectively positioned for reasons described below.

The spindle alignment guide 8 is releasably secured to the base 4 in a manner similar to that described for the jig alignment guide 6. The screws 16 pass through a pair of positioning holes 26 in the spindle alignment guide 8 and a corresponding pair of positioning holes 28 in the base 4. A plurality of positioning holes 28 are located on the base 4, as best seen in FIG. 2. The positioning holes 28 are preferably spaced at predetermined and known increments. The plurality of positioning holes 28 allows the spindle alignment guide 8 to be releasably secured to the base 4 in a plurality of locations.

The holes 20A and 20B in the jig alignment guide 6, the holes 26 in the spindle alignment guide 8, and the positioning holes 22A, 22B and 28 in the base 4 are preferably positioned such that when the jig alignment guide 6 and the spindle alignment guide 8 are secured to the base 4, the spindle alignment guide 8 is placed in parallel relationship with the jig alignment guide 6. By placing the spindle alignment guide 8 in parallel relationship with the jig alignment guide 6, subsequently installed spindles will be placed in parallel relationship with each other. While the FIGURES depict the jig alignment guide 6 and the spindle alignment guide 8 orthoganally aligned with the base 4, the positioning holes 22A, 22B and 28 may be placed such that the jig alignment guide 6 and the spindle alignment guide 8 are not orthoganally aligned with the base 4. It should be noted that the positioning holes 22A and 22B are provided at both ends of the base 4, thereby allowing the jig alignment guide to be attached at either end of the base 4. The jig 2 may then be used to install spindles in either a left to right direction, or in a right to left direction. (The jig 2 of FIG. 1 is assembled to allow a right to left installation of spindles). It should be further noted that positioning holes 20A and 20B in the jig alignment guide 6 and positioning holes 26 in the spindle alignment guide 8 are likewise provided to allow operation and use of the jig from either direction.

When the jig alignment guide 6 is secured to the base 4, the jig alignment guide 6 functions to denote a point from which subsequently installed spindles will be spaced. The distance between subsequently installed spindles is determined by the spacing between the jig alignment guide 6 and the spindle alignment guide 8. The distance between the jig alignment guide 6 and the spindle alignment guide 8 is determined by the distance between the positioning holes 22A or 22B (whichever is used for securing the jig alignment guide 6) and the plurality of positioning holes 28 (used to position the spindle alignment guide 8). As described above, the plurality of positioning holes 28 are preferably spaced at known increments from the positioning holes 22A and 22B. A series of index marks 32 are preferably provided on the base 4 to indicate the distance between the positioning holes 22A or 22B and the positioning holes 28. For ease of use, the index marks 32 may be adjusted to indicate the final spacing between subsequently installed spindles when the jig alignment guide 6 and the spindle alignment guide 8 are secured in the desired position.

As shown in FIGS. 1 and 2 and described above, the plurality of positioning holes 28 are located along the base 4 at discrete and known intervals. For example, the plurality of positioning holes 28 may be positioned at ½ inch increments, thereby allowing spindles to be spaced from each other at ½ inch increments. However, the discrete increments provided by the plurality of positioning holes 28 may not satisfy the needs of the user in all instances. For example, a user may need spindles spaced at a distance not obtainable with the provided ½ inch increments, and may instead desire a spacing requiring, for example, a ¼ inch increment. The positioning holes 22A and 22B in the base 4 allow the jig alignment guide 6 to be selectively secured in one of two different positions on the base 4, thereby allowing the jig 2 to accommodate an increased range of spacing increments. For example, the jig alignment guide 6 may normally be positioned and secured to the base 4 using the positioning holes 22A. When the jig alignment guide 6 is secured to the base using the positioning holes 22A, the plurality of positioning holes 28 would provide incremental spacing between the jig alignment guide 6 and the spindle alignment guide 8 at even ½ inch increments, i.e., 2 inches, 2½ inches, 3 inches, and so on. The positioning holes 22B are preferably positioned either ¼ inch further from or closer to the plurality of positioning holes 28 than are positioning holes 22A. The positioning holes 28 would then provide distances between the jig alignment guide 6 and the spindle alignment guide 8 which are ¼ inch different than those provided when the jig alignment guide 6 was secured via positioning holes 22A, i.e., 2¼ inches, 2¾ inches, 3¼ inches, and so on. Thus, the jig 2 may effectively provide ¼ inch spacing increments by the selection of either positioning holes 22A or 22*b*. It should be noted that the spacing increments given above are illustrative only and are not intended to be limiting. Any desired spacing increment may be used.

The spacing between the jig alignment guide 6 and the spindle alignment guide 8 may alternatively be determined by providing a longitudinal slot (not shown) in place of the plurality of positioning holes 28, or the positioning holes 22A and 22B. By using a longitudinal slot instead of discrete holes, any desired spacing between the jig alignment guide 6 and the spindle alignment guide 8 may be obtained by simply sliding the guide 6 or the guide 8 along the provided slot.

When installing spindles in a spindle railing system, it is typically desired that the spindles have a uniform height. A spindle height adjustment means 35 is thus provided on the spindle alignment guide 8. A spindle height restraint 36 is releasably secured to the spindle alignment guide 8 with a screws 38 and wing nuts 40 or other suitable fastening means. The spindle height restraint 36 is preferably securable along the length of the spindle alignment guide 8 to permit a range of spindle heights. As depicted in FIGS. 1 and 2, the spindle height restraint 36 may be slidably secured along a slot 42 in the spindle alignment guide 8. The spindle height restraint 36 may also alternatively be positionable along the spindle alignment guide 8 at discrete intervals. Similarly, the spindle height restraint 36 may be releasably secured to the spindle 10 alignment guide 8 by any suitable means known in the art. A graduated index 44 may be provided on the spindle alignment guide to indicate the distance of the spindle height restraint 36 from a reference surface, such as a bottom surface 45 of the base 4.

Figure 6:
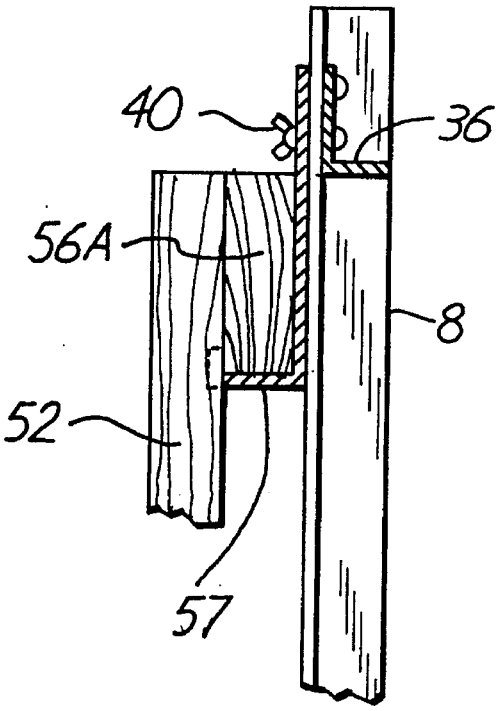
FIG. 6 is an alternative construction of the spindle railing system depicted in FIG. 4.
Figure 5:
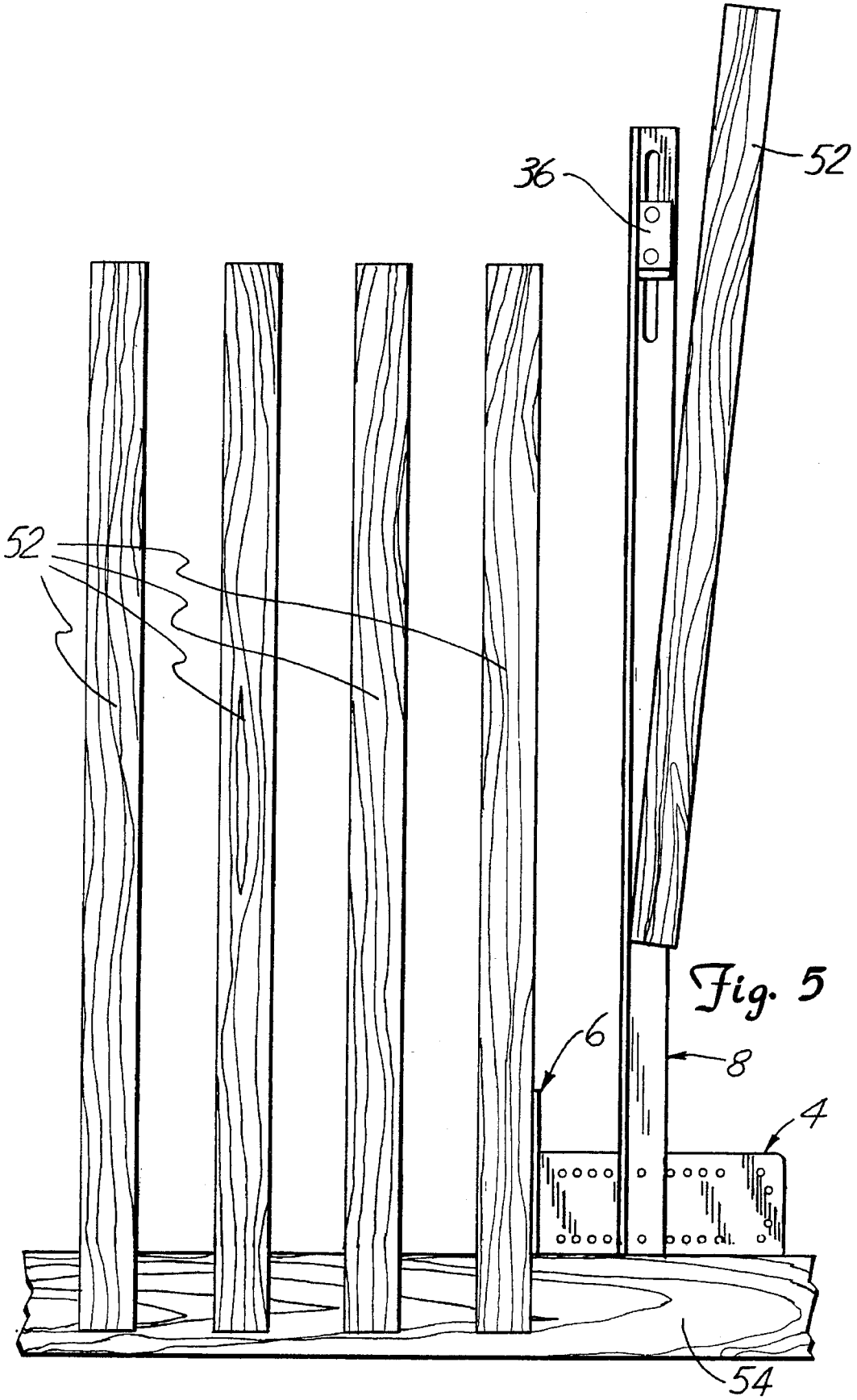
FIG. 5 is an elevational view of the present invention being used to install a spindle in the spindle railing system of FIG. 3.
Figure 9:
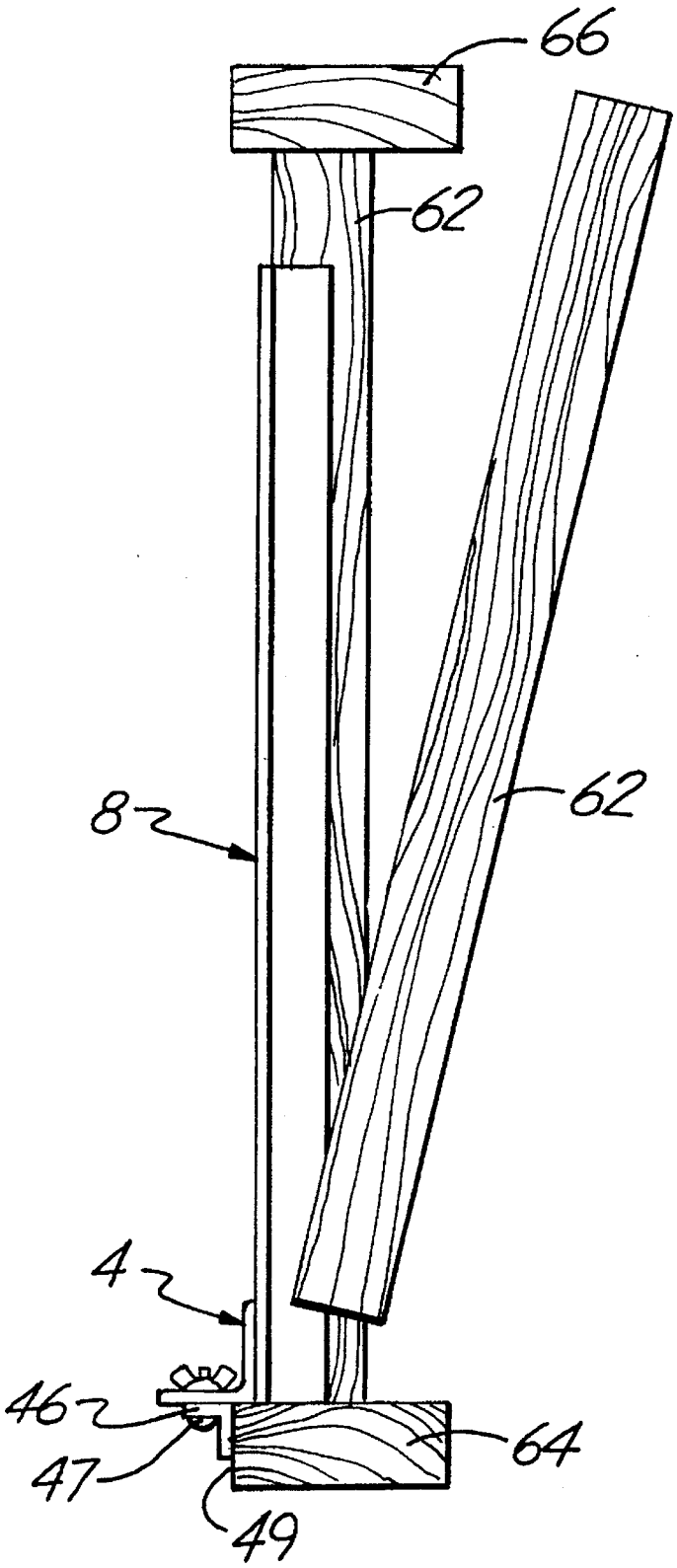
FIG. 9 is a side elevational view of the present invention taken along lines 9—9 of FIG. 8.

In some instances, it may be desired to offset a spindle from a reference surface. For example, it may be desired to place spindles along the center of a board rather than flush with an edge of the board. In such instances, the jig 2 may be provided with a jig offset guide 46 as best seen in FIGS. 2, 5 and 6. The jig offset guide 46 is preferably slidably secured to the base 4 by screws 47 or any other suitable fastening means known in the art, thereby allowing the jig offset guide 46 to move along slots 48 in the base 4. The spindles may then be offset from a reference surface. As is best seen in the example of FIG. 9, the jig offset guide 46 abutts against a reference surface 49, thereby allowing the spindles to be placed in an offset position relative to the reference surface 49.

OPERATION

The operation of the jig 2 of the present invention will be illustrated for the installation of two types of spindle railing systems. First, the installation of spindles which are attached to a rim joist or skirt board will be described (FIGS. 3–6), and then the installation of spindles in a suspended railing system (FIGS. 7–9) will be described.

A spindle railing system 50 in which spindles 52 are attached to a rim joist or skirt board 54 is illustrated in FIGS. 3–6. The spindles 52 are spaced at a uniform distance, aligned parallel to each other, and have a uniform height. A top cord 56 extends across the spindles 52. The spindle railing system 50 of FIG. 3 may be easily created using the jig 2 of the present invention in the following manner. First, the desired spacing between the spindles 52 and the desired height of the spindles 52 are determined, and the jig alignment guide 6, spindle alignment guide 8 and the spindle height restraint 36 are positioned to provide the desired spacing and spindle height. The first spindle 52 is then installed using the spindle alignment guide 8 of the present invention to properly determine the height and alignment of the spindle 52 relative to the rim joist or skirt board 54. The user only needs to determine the position of the initial spindle along the length of the rim joist or skirt board 54. The first spindle 52 is typically installed at a corner or abutting a surface (such as a wall) to which the railing system will be secured. Thus, for example, the user positions the first spindle 52 flush with a corner surface and uses the jig 2 to accurately set the height and alignment of the spindle 52 in the manner to be described next. The spacing, alignment and height of all subsequently installed spindles are then determined solely by the jig 2.

After the initial spindle 52 has been secured to the rim joist or skirt board 54, subsequent spindles 52 are installed in the manner illustrated in FIG. 5. To install each spindle 52, the jig alignment guide 6 is abutted against the previously installed spindle 52. The spindle 52 to be installed is placed adjacent the spindle alignment guide 8 and abutted against the spindle height restraint 36. At this point, the spindle 52 to be installed is located at the correct distance from the previous spindle 52, is aligned in parallel relationship with the previous spindle 52, and is located at the correct height. The spindle 52 is easily held in place by the user with only one hand. The user then simply secures the spindle 52 to the rim joist or skirt board 54 using any fastening means known in the art, such as a screw or nail (not shown). The jig 2 is then repositioned adjacent the newly installed spindle 52 in the manner described above, and the next spindle 52 is installed in a similar manner. The process is continued until all of the desired spindles 52 are installed. After all of the spindles 52 are secured to the rim joist or skirt board 54, the top cord 56 may be secured to the spindles 52 by any manner known in the art.

Figure 4:
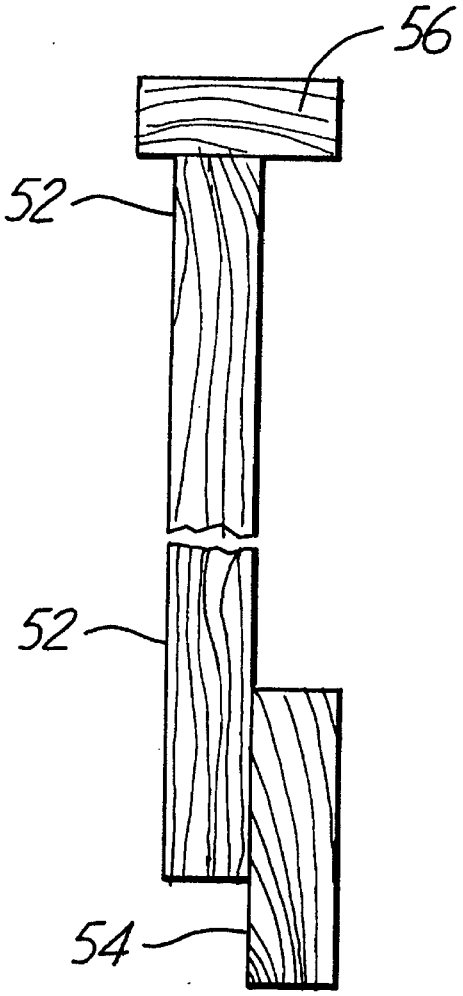
FIG. 4 is an elevational view of a spindle railing system taken along line 4—4 in FIG. 3.

Top railing cord 56 is commonly positioned across the tops of the spindles 52, as depicted in FIG. 4. However, a top railing cord 56A is also commonly positioned along the sides of the spindles 52 with the top cord 56A flush with the tops of the spindles 52, as depicted in FIG. 6. When installing the top cord 56A in the latter position, it is very difficult for a single person to hold the top cord 56A in the proper position and simultaneously secure the top railing cord 56A to the spindles 52, because the top cord 56A is unsupported by the spindles 52 and tends to slide downward. Thus, two people are typically required to secure the top railing cord 56A into position, with one person holding the top railing cord 56A in the proper position and the second person fastening the top cord 56A to the spindles 52. A top cord rest 57, as depicted in FIG. 2, may thus be provided for the jig 2 to allow a single user to secure the top cord 56A to the sides of the spindles 52 as seen in FIG. 6. Top cord rest 57 is preferably secured to the spindle alignment guide 8 in combination with the spindle height restraint 36. The top cord rest 57 is preferably shaped to support the top cord 56A at a height which places the top cord 56A flush with the tops of the spindles 52. The top cord 56A may then be secured to the sides of the spindles 52 by a single user by simply supporting one end of the top cord 56A and the top cord rest 57, while securing the opposite end of the top cord 56A to the spindles 52.

Figure 7:
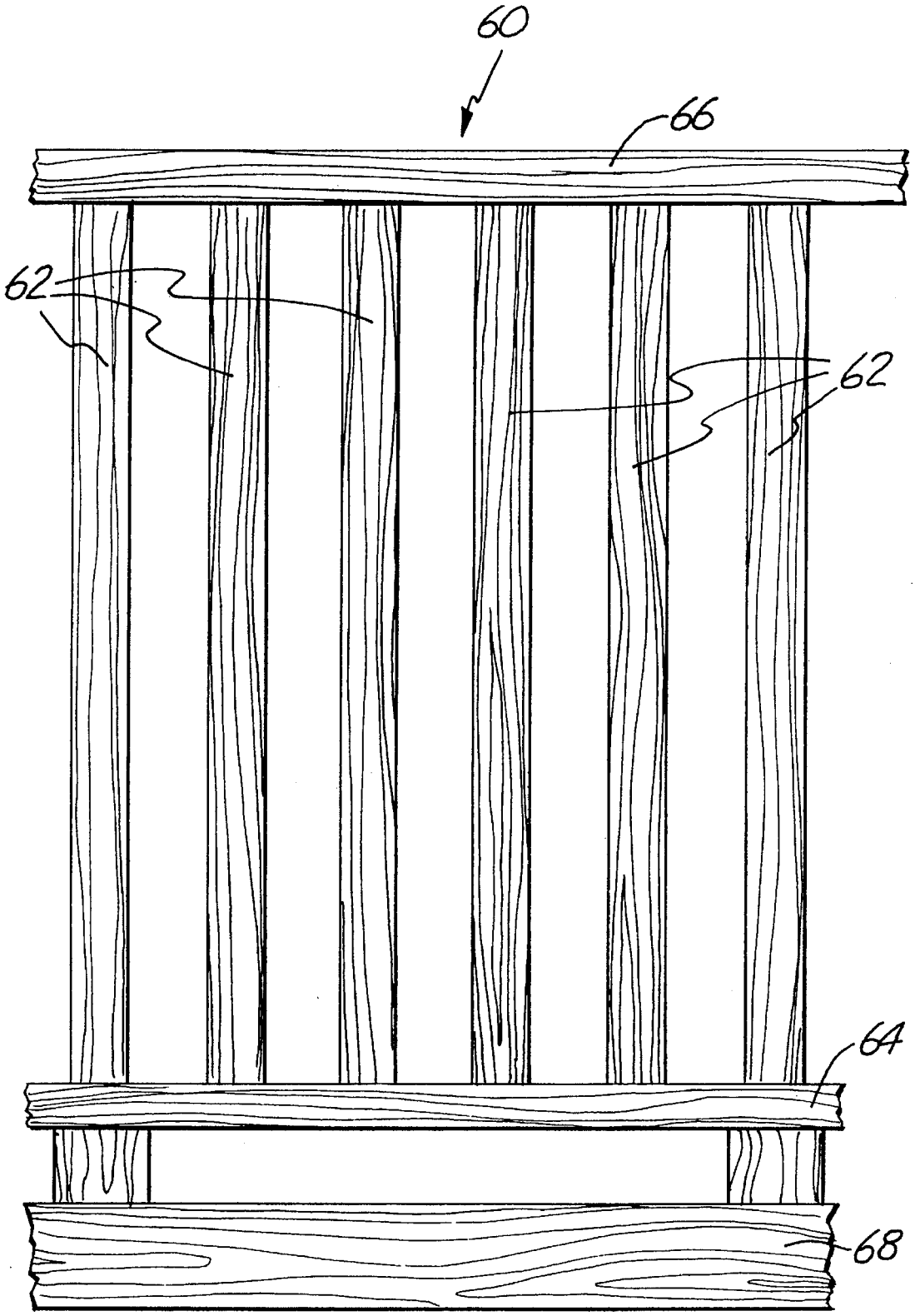
FIG. 7 is an elevational view of an alternative spindle railing system.
Figure 8:
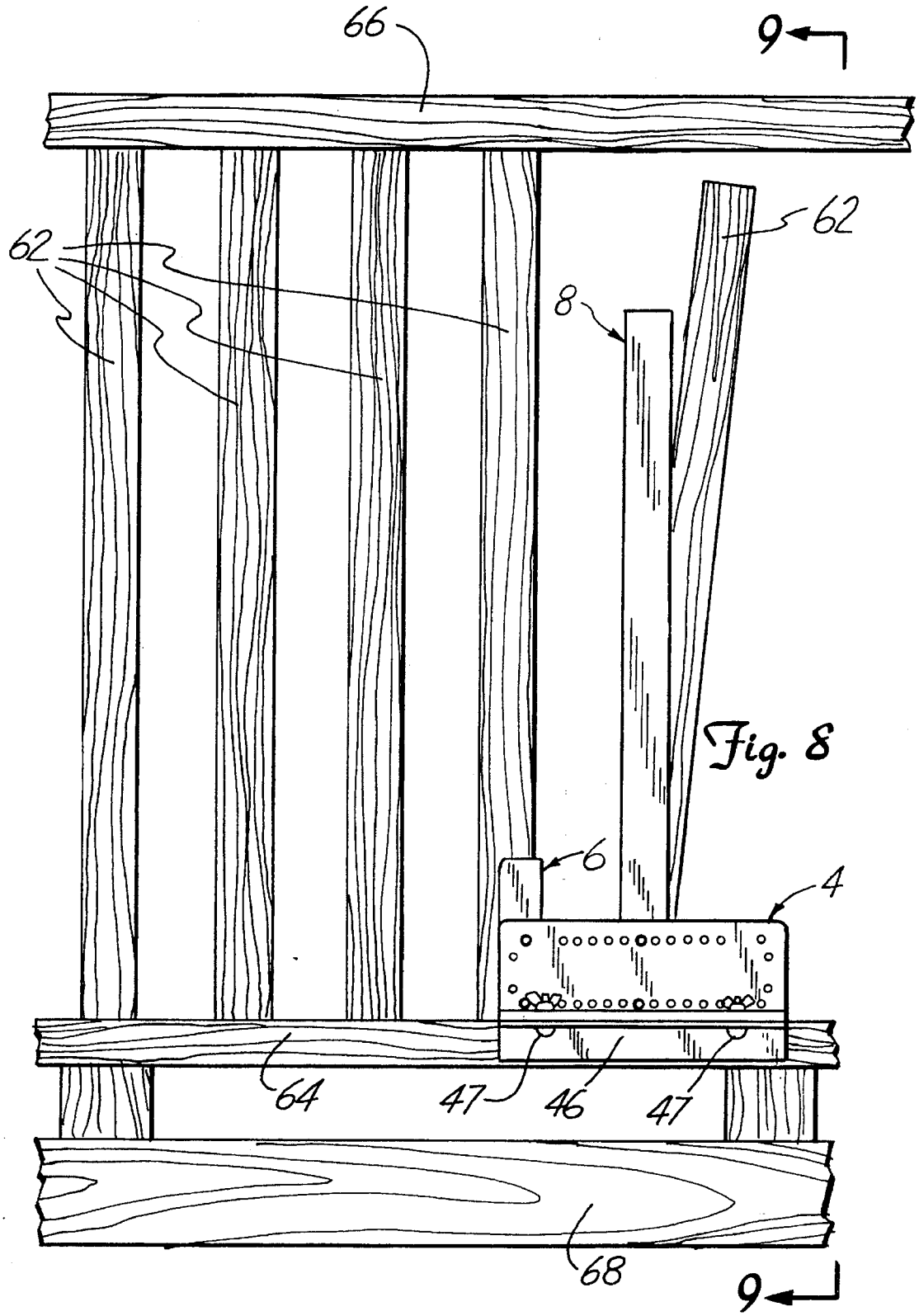
FIG. 8 is an elevational view of the present invention being used to install a spindle in the suspended spindle railing system of FIG. 7B.

A suspended railing system 60 is illustrated in FIG. 7. The spindles 62 are suspended between a bottom cord 64 and a top cord 66. The bottom cord 64 is suspended above a floor 68. Spindles 62 in a suspended railing system 60 are installed in a manner very similar to that described above. Some differences do exist, however. For example, because the spindles 62 are secured between a bottom cord 64 and a top cord 66, it is not necessary to use the spindle height restraint 36 to accurately determine the height of the spindles 62. When the use of the spindle height restraint 36 is not required, the spindle height restraint 36 may be removed from the spindle alignment guide 8. If the spindle alignment guide 8 is too long to fit between the bottom cord 64 and the top cord 66, a shorter spindle alignment guide may be provided which fits between the bottom cord 64 and the top cord 66, as is shown in FIG. 8. Also, the spindles 62 in a suspended railing system 60 are often offset from the edge of the bottom cord 64 and the top cord 66, as best seen in FIG. 6. As described above, the jig offset guide 46 may be attached to the base 4 of the jig 2 and thereby allow the spindles 62 to be offset from the edges of the bottom cord 64 and the top cord 66.

After the jig 2 has been provided with the proper spindle alignment guide 8 and with the jig offset guide 46 (if required), the jig alignment guide 6, the spindle alignment guide 8 and the jig offset 46 are adjusted to provide the desired spacing between spindles 62, and the desired offset of the spindles 62. The first spindle 62 is installed at the desired location by first abutting the jig offset guide 46 against the bottom cord 64 to properly align the jig 2. The spindle 62 is then placed adjacent the spindle alignment guide 8 to properly align and offset the spindle 62. The spindle 62 is then secured by any means known in the art. To install a subsequent spindle 62, the jig 2 is positioned such that the jig alignment guide 4 and the jig offset guide 46 abut the previously installed spindle 62 and the bottom cord 64, respectively, as best seen in FIGS. 8 and 9. The spindle 62 to be installed is placed in the spindle alignment guide 8, at which point the spindle 62 to be installed is properly spaced from the previous spindle and aligned with the previous spindle. The user then secures the spindle 62 to the bottom cord 64 and the top cord 66 by any manner known in the art. The jig 2 is repositioned to install another spindle 62, and the process described above is repeated until all spindles 62 are secured.

ALTERNATIVE EMBODIMENTS

Figure 10:
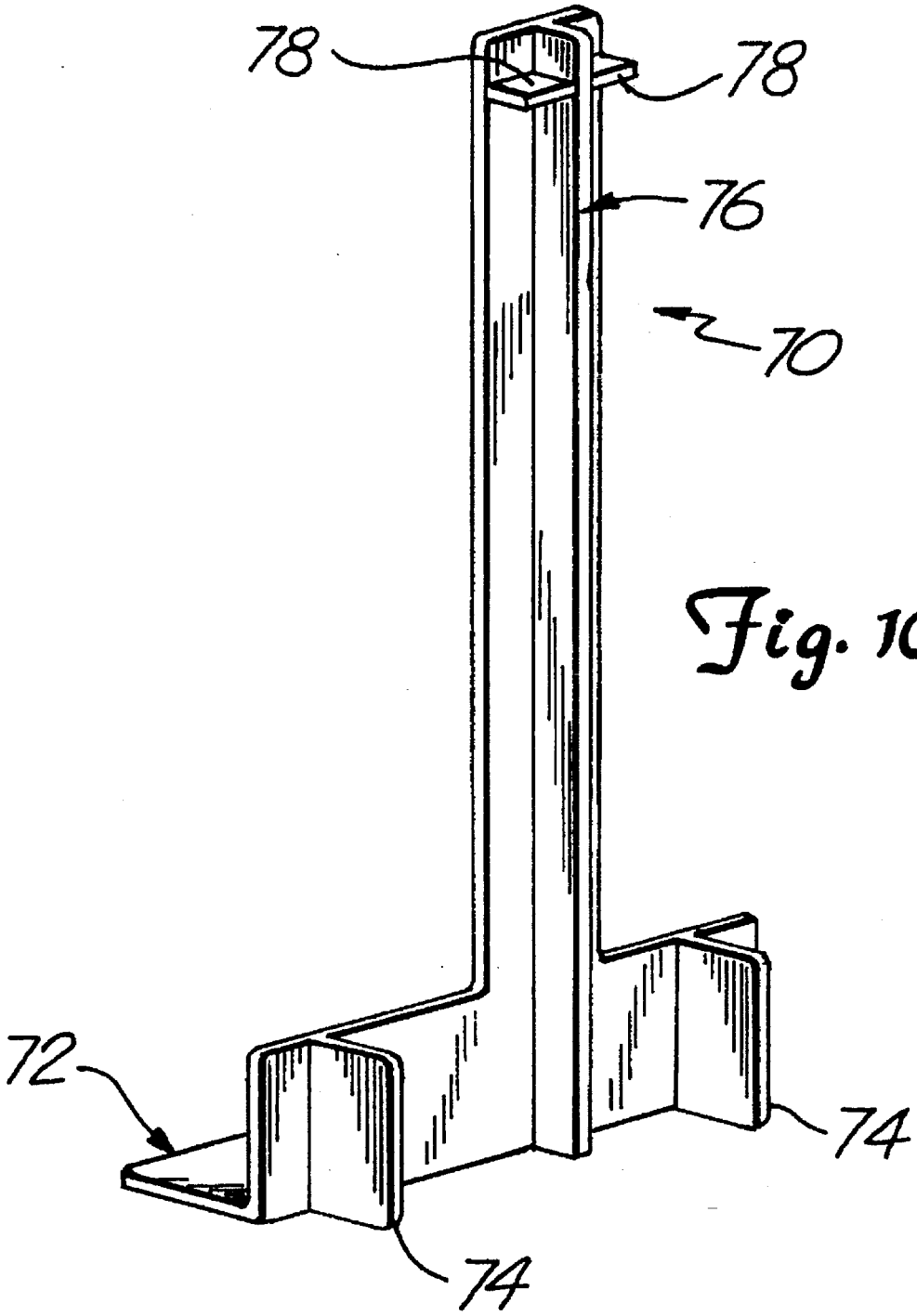
FIG. 10 is a perspective view of an alternative embodiment of the present invention.

While the above described adjustable jig is ideally suited for use by professional builders who have a need for a wide variety of railing spindle spacings, not all individuals require such versatility. For example, many individual homeowners undertake "do-it-yourself" home improvement projects such as adding a deck to a home. These individual homeowners do not require the versatility of the above described jig. Instead, only a single spindle spacing and height is desired, and a widely adjustable jig is not necessary if a nonadjustable jig is provided with the desired dimensions. Often, the expense of a fully adjustable jig may not be justifiable by the homeowner. To accommodate those situations, it may be desired to provide a non-adjustable jig, which provides a standard spindle spacing and height for certain applications, such as deck railing systems. A non-adjustable embodiment of the present invention is illustrated in FIG. 10. The jig 70 is preferably formed as a single unit from a suitably rigid material. For example, the jig 70 could be injection molded from a suitable polymeric material. Such a construction would significantly lower the cost of the jig 70. The jig 70 includes a support base 72 with integrally molded jig alignment guides 74 and an integrally molded spindle alignment guide 76. The jig alignment guides 74 are preferably provided at both ends of the support base 72 to allow the user to install a railing system in either a left to right direction, or in a right to left direction. The spindle alignment guide 76 is preferably formed as a T-shaped member as illustrated in FIG. 10. The T-shape of the spindle alignment guide 76 allows the jig 70 to be used in either a left to right direction or a right to left direction, and also increases the stiffness of the spindle alignment guide 76 to ensure accurate placement of the spindles. A height restraint 78 is preferably formed as an integral part of the spindle alignment guide 76. Alternatively, the height restraint 78 may be made adjustable in the manner described earlier for the fully adjustable jig.

Although the present invention has been described with reference to preferred embodiments, workers skilled in the art will recognize that changes may be made in form and detail without departing from the spirit and scope of the invention.

What is claimed is:

1. A jig for use in uniformly installing spindle railing systems comprising a plurality of railing spindles in predetermined spaced relation extending from a reference surface defined by a floor, rim joist, skirt board, or bottom railing cord to a top railing cord, the jig comprising:

a support including a base member adapted to be positioned upon the reference surface;

a jig alignment guide attached to the base member, the jig alignment guide having a surface arranged to abut a surface of an installed spindle of the spindle system;

a spindle alignment guide having a surface for abutting a substantial portion of a surface of an unsecured railing spindle to be installed, the spindle alignment guide secured to the base member at a predetermined distance from the jig alignment guide, the predetermined distance corresponding to the predetermined spaced relation of adjacent railing spindles of the spindle system; and height adjustment means attached to the spindle alignment guide to locate the unsecured spindle at a desired height from the reference surface.

2. The jig of claim 1, wherein the surface of the spindle alignment guide is substantially parallel to the surface of the jig alignment guide to align the unsecured railing spindle in parallel relationship to the installed railing spindle.

3. The jig of claim 1, wherein the spindle alignment guide comprises an elongated channel shaped to receive the unsecured spindle and align the unsecured spindle relative to the installed railing spindle.

4. The jig of claim 3, wherein a top cord rest is attached to the elongated channel to support the top railing cord for attachment to the railing spindles.

5. The jig of claim 1, further comprising:

adjustment means for adjusting the distance between the jig alignment guide and the spindle alignment guide; and an index portion on the base member to progressively gauge the predetermined spaced relation of the railing spindles commencing from an initial starting point and from each subsequently installed railing spindle.

6. The jig of claim 1, including a jig offset guide releasably secured to the base member for offsetting railing spindles from an edge of the floor, rim joist, skirt board or railing cord from which the spindles extend.

7. The jig of claim 1, wherein the height adjustment means comprises a restraint tab slidably secured to the spindle alignment guide.

8. An adjustable jig for aligning and spacing railing spindles of a spindle system in predetermined spaced relation, the adjustable jig comprising in combination: a support including a base member adapted to be positioned upon a reference surface; a jig alignment guide attached to the base member, the jig alignment guide having a surface arranged to abut a surface of an installed spindle of the spindle system;

a spindle alignment guide having a surface substantially parallel to the surface of the jig alignment guide for abutting a substantial portion of a surface of an unsecured spindle to be installed; and an index means releasably attaching the spindle alignment guide to the base member at a desired position to adjust the spacing between the jig alignment guide and the spindle guide to thereby align successive spindles in substantially parallel relation at the desired spacing.

9. The jig of claim 8, wherein the index means comprises a plurality of positioning holes located at discrete intervals from the jig alignment guide, the positioning holes for use in releasably attaching the spindle alignment guide to the base member.

10. The jig of claim 8 wherein the spindle alignment guide is an elongated channel shaped to align the unsecured spindle in parallel relationship to the installed spindle.

11. The jig of claim 8, further comprising a height adjustment means attached to the spindle alignment guide to locate the unsecured spindle at a desired height from the reference surface.

12. The jig of claim 9, further comprising a jig offset guide releasably secured to the base member for offsetting the jig from the reference surface.

13. A jig for use in uniformly installing spindle railing systems, wherein spindle railing systems generally comprise a plurality of spindles extending from a floor, rim joist, skirt board or bottom railing cord to a top railing cord, the jig comprising:

an elongated base member having a first end and a second end, the base member adapted to be positioned upon a reference surface on or adjacent a floor, rim joist, skirt board or bottom railing cord from which spindles extend;

a jig alignment guide attached to the first end of the base member, the jig alignment guide having a surface to abut a surface of an installed spindle of the spindle system, the surface of the jig alignment guide denoting a point from which a subsequently installed spindle will be spaced;

a spindle alignment guide having a surface arranged to receive and align a substantial position of a surface of an unsecured spindle; and adjustment means releasably attaching the spindle alignment guide to the base member so that the surface of the spindle alignment guide is substantially parallel to the surface of the spindle alignment guide, the adjustment means attaching the spindle alignment guide to the base at a desired position adjust the distance between the surface of the spindle alignment guide and the surface of the jig alignment guide thereby defining the distance between adjacent spindles of the spindle system.

14. The jig of claim 13, wherein the spindle alignment guide comprises an elongated channel.

15. The jig of claim 13, further comprising a height adjustment means attached to the spindle alignment guide for locating the unsecured spindle at a desired height from the reference surface.

16. The jig of claim 13, further comprising a jig offset guide slidably secured to the base member for locating the jig a desired distance from the reference surface.

17. The jig of claim 13, further comprising:

index markings on the base member to progressively gauge the distance between the surface of the jig alignment guide and the surface of the spindle alignment guide.

18. The jig of claim 13, further comprising:

attachment means on the base member for releasably securing the jig alignment guide to either the first end of the base member or the second end of the base member.

* * * * *

UNITED STATES PATENT AND TRADEMARK OFFICE

CERTIFICATE OF CORRECTION

PATENT NO. : 5,491,905
DATED : February 20, 1996
INVENTOR(S) : Jeffrey C. Jablonski, et. al.

It is certified that error appears in the above-indentified patent and that said Letters Patent is hereby corrected as shown below:

Column 1, line 25-26, delete "re,checking", insert --rechecking--.

Column 5, line 7, after "spindle", delete "10"--.

Signed and Sealed this

Seventh Day of May, 1996

Bruce Lehman

*Attest:*

BRUCE LEHMAN

*Attesting Officer*

*Commissioner of Patents and Trademarks*